United States Patent [19]

De Prijcker et al.

[11] Patent Number: 4,814,809

[45] Date of Patent: Mar. 21, 1989

[54] PHOTOGRAPHIC PROCESSING APPARATUS AND METHOD

[75] Inventors: Jozef P. De Prijcker, Hamme; Albrecht F. Domen, Bornem; Marcel R. Fierens, Duffel; Henri J. Van Hal, Wuustwezel, all of Belgium

[73] Assignee: AGFA-GEVAERT N.V., Mortsel, Belgium

[21] Appl. No.: 132,564

[22] Filed: Dec. 14, 1987

[30] Foreign Application Priority Data

Dec. 19, 1986 [EP] European Pat. Off. ... EP 86202337.1

[51] Int. Cl.[4] ..... G03D 3/06

[52] U.S. Cl. ..... 354/319; 354/324; 222/83; 222/85

[58] Field of Search ..... 354/318, 319, 324, 325, 354/323, 320, 321, 322; 222/81, 82, 83, 83.5, 85, 86

[56] References Cited

U.S. PATENT DOCUMENTS

| | | | |
|---|---|---|---|
| 3,557,680 | 1/1971 | Kaminstein et al. | 222/82 |
| 3,901,253 | 8/1975 | Collins et al. | 222/86 |
| 4,103,358 | 7/1978 | Gacki et al. | 354/323 |
| 4,312,595 | 1/1982 | Houseman et al. | 354/323 |
| 4,629,303 | 12/1986 | Vermarien | 354/324 |
| 4,634,252 | 1/1987 | Jeremijevic | 354/324 |
| 4,688,917 | 8/1987 | Muller et al. | 354/324 |

*Primary Examiner*—A. A. Mathews

*Attorney, Agent, or Firm*—William J. Daniel

[57] ABSTRACT

A processing apparatus with several liquid stations for the wet processing of image-wise exposed photographic elements, e.g. sheets, wherein the different processing liquids are provided in different liquid compartments (85, 86, 87) of the processing cassette (72), that has openings (88,89,90,91) that are sealed by membranes (92), and wherein the rinsing water compartment is provided with perforate partitions (94) with a scavenging agent for removal of fixing agent ions and complexed silver ions from the rinsing water in said compartment.

8 Claims, 9 Drawing Sheets

PHOTOGRAPHIC PROCESSING APPARATUS AND METHOD

BACKGROUND OF THE INVENTION

1. Field of the Invention

The present invention relates to a photographic apparatus and method for the processing of image-wise exposed photographic silver halide emulsion layer elements, and in particular to such apparatus and method for the convenient processing of photographic film sheets with micro-images, such as COM (computer output microfilm) fiches, that are produced by so-called low-end users, or microfilm recorded in a microfilm camera.

Micro-images are commonly photographically processed according to one of the following two processes.

The first process is a "dry processing" silver halide system, wherein an image is generated after exposure and thermal development of a light-sensitive layer containing minor amounts of light-sensitive silver halide, an organic silver soap and a reducer. This system has the important advantage of dry processing (no liquids), but it has been shown that the storage conditions of the film are critical, and that the processing is temperature-dependent, resulting in variations in the gradation and the maximum density of the film. A further disadvantage is the low archivability of these images.

The second process is the classic silver halide process that offers very satisfactory images, but that is hampered by the use of a developer liquid that requires controlled regeneration in view of aerial oxidation, and that thereby is less convenient, in particular for the low-end user who makes approximately 5 to 50 microfiches per week.

2. Description of the Related Art.

It is known in other domains of photographic reproduction, for instance for graphic line and screen-work, to use light-sensitive silver halide emulsion material that incorporates its own developing agents which become active by contact with an alkaline activation solution. In this process, there is no premature oxidation of the developing agents by exposure of the developing liquid to the air as in conventional silver-halide photography, whereby the processing liquid regeneration becomes more simply.

The convenience of photographic processing is further improved if the processing solutions are supplied to the different processing stations by means of bottles of a reduced content, e.g. 1 1 bottles, that are placed in inverted position on the apparatus and the content of which is supplied to processing stations with a chicken-feed level control system.

Activation-type photographic processing apparatus of this kind can be left in stand-by condition for periods ranging from days to weeks, and yet they are capable of producing good processing results after a few seconds of running-in.

In spite of the mentioned advantages, the described inverted bottle-type processing apparatus still show some disadvantages which make their use less convenient than it could be.

A first disadvantage is formed by a particular valve that is required for the bottles with processing liquid, and that becomes only opened at the moment the inverted bottle reaches its operative position in the fitting of the apparatus.

Another point is that a bottle may run dry. This is not a serious problem in the processing of large-format images, e.g. an A4 format sheet, since the discarding of one unsatisfactory processed image usually does not mean a great loss. However, in the case of COM recordings, one film fiche may contain up to 120 different images, and the loss of one film sheet in consequence means that all these different recordings must be done over.

If an empty bottle is replaced by a fresh one, and the other bottle(s) is (are) not replaced at that moment, it may take only a short time before another bottle runs dry and leads on its turn to the immobilisation of the apparatus.

Furthermore, the holder for rinsing water must be overproportionally large, since the rinsing water becomes loaded with substances that were dissolved and leached out by the fixing of the developed photographic silver halide element. The concentration of such substances in the rinsing liquid may not surpass a given level otherwise the rinsing becomes unsufficient. The latter problem may be overcome by the connection of the apparatus to tap water supply, but this measure considerably reduces the convenience of use of the apparatus.

Finally, the different processing stations must be provided with liquid discharge means in order to empty such stations prior to their removal from the apparatus for cleaning purposes or servicing. In the case of processing sections in the form of shallow trays that are not emptied while in the apparatus, the operator must carefully remove such tray from the apparatus and bring it to a sink for pouring away the liquid.

It is an object of the present invention to provide an improved photographic processing apparatus for the wet processing of exposed photographic silver halide emulsion layer elements e.g. sheets, the use of which, and in particular the use of the processing solutions involved in its operation, is more convenient than in the known apparatus.

It is further an object of the present invention to combine convenience of processing with an economical use of processing ingredients and wash water without detrimental effects on the archival properties of the final image.

A still further object of the invention is the provision of an apparatus of the type referred to, which is compact and can readily be used in an office.

SUMMARY OF THE INVENTION

In accordance with the present invention, a photographic processing apparatus for the processing of photographic silver halide emulsion layer elements, comprising processing stations wherein developer or activator liquid, fixing and rinsing processing liquid is progressively applied to said element as said element is moved through such stations, and wherein such liquid is also progressively removed from said element after said element leaves such stations and means for transporting said element through the apparatus, means for co-operation with the openings of holders with processing liquid which are removably connected with the apparatus so that liquid of the holders can flow by gravity from the holders into the processing stations, is characterized thereby that the holders are in the form of a processing cassette that has different compartments for the different processing liquids, that said different compartments are sealed by membranes that are perforable by perforation means provided in the apparatus, and that the rinsing water compartment is provided with a scavenging agent for removing fixing agent ions and complexed silver ions from the rinsing water in said compartment.

The advantages offered by the inventive features of the apparatus are as follows.

The provision of the different processing liquids in compartments of one and the same holder hereinafter called cassette, definitely makes an end to problems related to the replacement of a plurality of holders.

The provision of said scavenging agent, preferably a thiosulphate and silver thiosulphate complex ion scavenging agent, in the rinsing water compartment permits to drastically reduce the amount of water that is required for the satisfactory rinsing of the treated material, since the deterioration of the rinsing liquid proceeds much slower.

Finally, the sealing of the different compartments by perforable membranes and the perforation of such membranes by perforation means provided in the apparatus, completely eliminates the need for special valves for such compartments.

The apparatus may be designed such that closing of a lid or a cover that locks the cassette, automatically causes a displacement of the perforation means or of the cassette itself, whereby the perforation is performed.

The ion scavenger which according to a preferred embodiment is an ion exchanging agent capturing thiosulphate and complex type silver thiosulphate anions is preferably present in finely divided but undissolved form in an envelope of a porous of waterpermeable structure, e.g. filter bag, arranged in the rinsing water compartment of the cassette.

According to a preferred embodiment the processing apparatus of the present invention is used for the processing of photographic silver halide emulsion elements already containing developing agent(s) before their exposure so that development proceeds by applying an activator liquid being an alkaline aqueous liquid free from developing agent(s).

Theliquids that are used for the developing and the fixing in the apparatus according to the invention may include other ingredients influencing the photographic quality of the images and/or the processing speed and convenience. For example, an activator liquid and a fixing liquid that are conveniently applied to the photographic material with a lick-roller (meniscus coating) contain (a) watersoluble polymer(s) for optimizing the viscosity and the surface tension of the liquids in that coating technique.

A preferred watersoluble polymer for controlling the viscosity is polyacrylamide. Said polymer acts as a thickening agent and particularly well prevents the formation of a dry crusty difficultly dissolvable deposit on processing parts such as the lick-roller of the apparatus when the latter is not under work load. The gel-like coating formed on a dry roller is immediately removed by re-wetting in further processing.

According to a preferred embodiment an activator and/or fixing liquid contains polyacrylamide in a concentration in the range of 0.5 to 5.0 g/l.

A processing cassette with fresh processing chemicals for use in an apparatus according to the invention, may suitably be packaged in a packaging carton together with a number of sheets that can readily be processed in the amount of processing liquids contained in the processing cassette. Suchlike packaging has the advantage that the use of the last sheet warns the operator that the satisfactory operation of the processing liquids for still more sheets becomes doubtful, and that it is therefore indicated to use the processing cassette of a fresh packaging for the processing of a next run of film sheets.

A suitable way of feeding developer or activator and fixing solutions to the processing stations, is by means of a chicken-feeder level control means.

A suitable way of feeding the rinsing water to the rinsing station is by pump means. In this way, a relatively high rate of circulation of the liquid may be maintained in this station, and a single overflow edge may be used to control the liquid level in said station.

According to a first embodiment, the apparatus according to the invention is arranged for co-operation with a second processing cassette which is identic to the first one. The first cassette is arranged in an inverted position in the apparatus, at a level above that of the processing stations, thereby to feed the corresponding stations through a chicken feed control, and the second cassette is arranged in an upright position, at a level below that of the processing stations. Both cassettes are identical to each other. The cassette that takes the inverted position is used only for its activator and fixing compartments, whereas the cassette that takes the upright position is used for its rinsing water compartment. The liquid of said latter compartment may be pumped upwardly by an appropriate suction pump.

According to a second embodiment of the invention, the apparatus is arranged for co-operation with only one processing cassette, the construction of said cassette and its position in the apparatus being such that all the processing liquid compartments, except the rinsing water compartment, are at a level above the processing stations, and that the rinsing liquid compartment is at a level that is below that of the rinsing station.

The invention includes also a method for the convenient processing of photographic sheets.

A method of processing photographic sheets by means of an apparatus as characterized hereinbefore, comprises starting the first operation of the apparatus by means of a normal-type processing cassette (i.e. one that contains all the required processing solutions for the operation of the apparatus) that is placed in an inverted position in the apparatus, and of a particular start-type processing cassette that contains rinsing water only and that is placed in the upright position (as the second cassette) in the apparatus, using the processing liquids of the inverted cassette, except for the rinsing water, and using the rinsing water of the upright cassette and, after termination of the operational life of the processing liquids, discarding the start-type cassette, removing the cassette that takes the inverted position and inserting it in the upright position in the apparatus, and placing a fresh normal-type cassette in the inverted position as the first cassette in the apparatus.

BRIEF DESCRIPTION OF THE DRAWINGS

The invention will be described hereinafter by way of example with reference to the accompanying drawings wherein.

Figure 1:
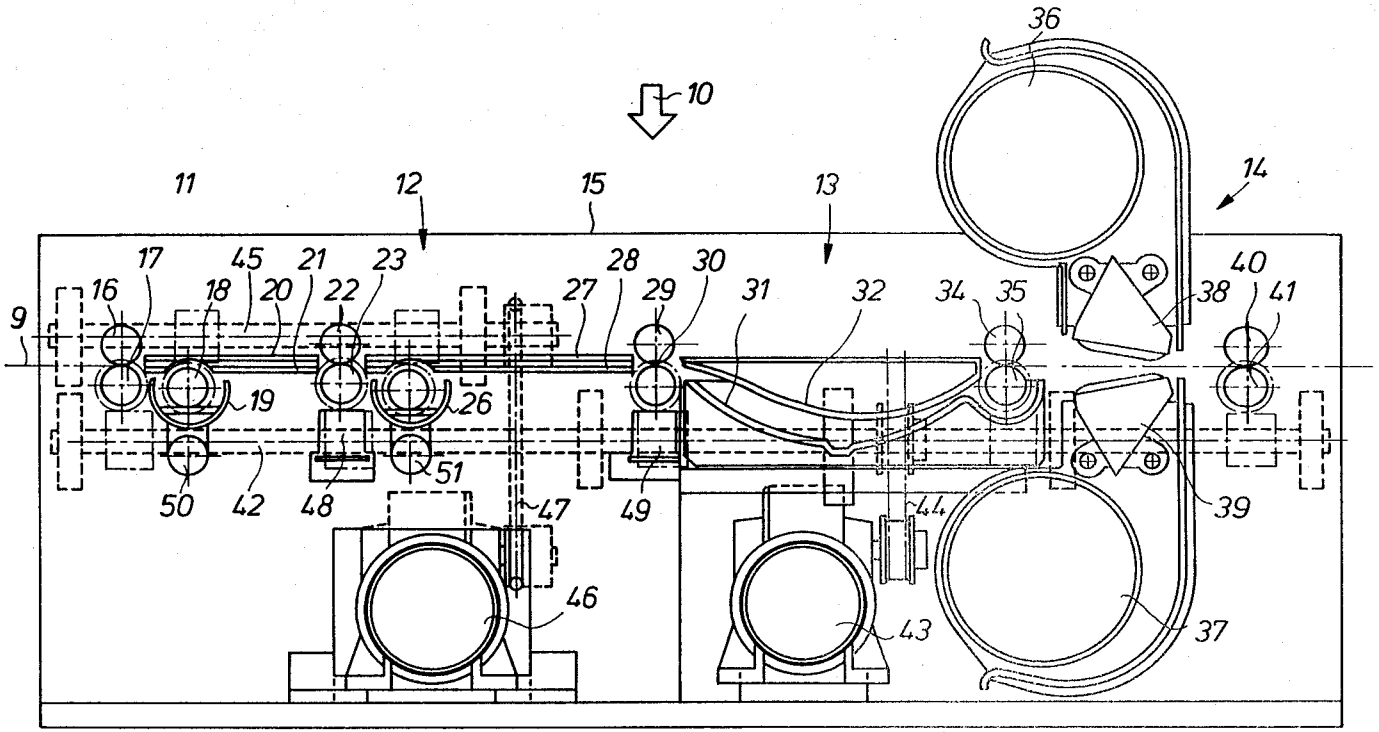
FIG. 1 is a longitudinal sectional view of one embodiment of an apparatus that operates with two processing cassettes.
Figure 2:
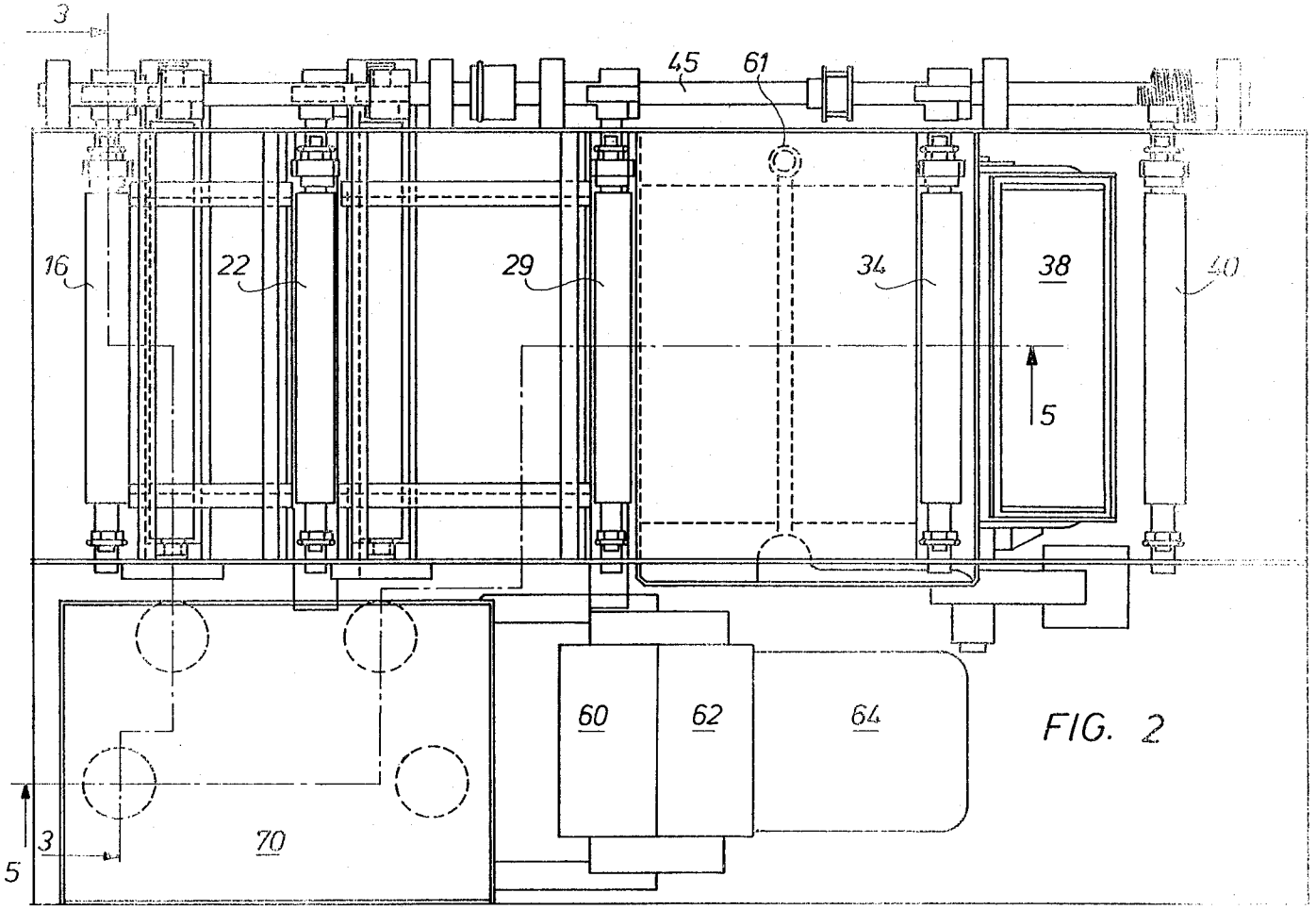
FIG. 2 is a plan view of the apparatus.
Figure 3:
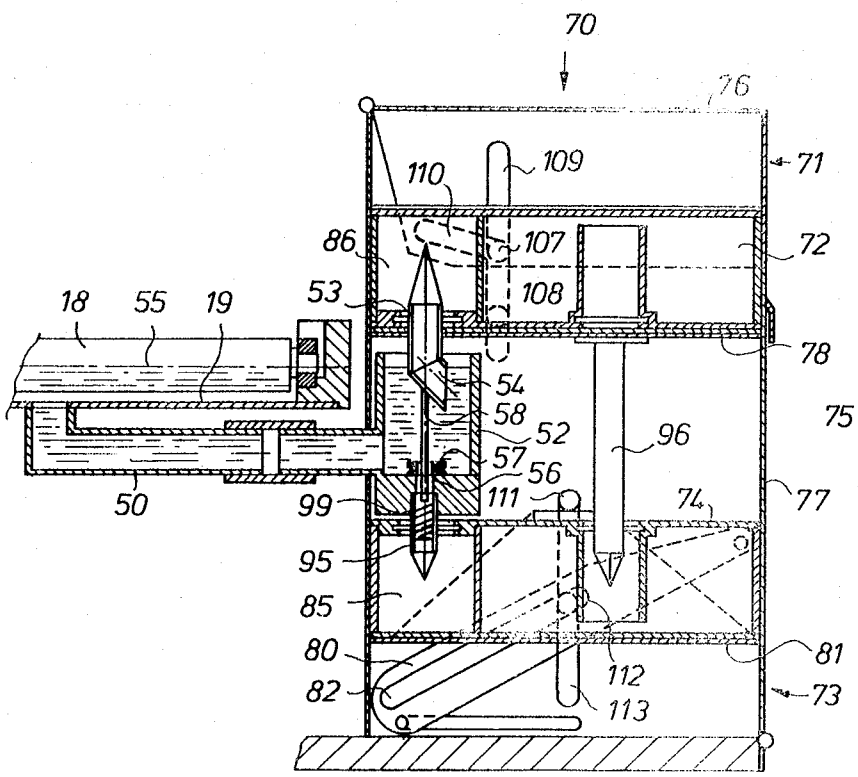
FIG. 3 is a sectional view of the apparatus on line 3—3 of FIG. 2, FIGS. 4*a* to 4*c* are different views of a liquid cassette used in the apparatus.

Referring to the apparatus illustrated in FIGS. 1, 2 and 3, the apparatus designated generally by the numeral 10, comprises a developing station 11, a fixing station 12, a rinsing station 13 and a drying station 14, all arranged in a light-tight housing 15.

The housing has an inlet opening 9 through which an exposed microfiche may be introduced in the apparatus, thereby to follow a path through the apparatus as indicated in broken lines.

The developing station 11 has a pair of driving rollers 16, 17 and a lick-roller 18 that rotates in a shallow tray 19. A pair of guide plates 20, 21 determine the position of the sheet in the developing station and they also guide the developed sheet to the next driving roller pair 22, 23.

The driving rollers 22, 23 squeeze off the developing liquid from the sheet and they advance the sheet through the fixing station 12 in which a lick-roller 25 applies the fixing solution contained in a tray 26.

Guide plates 27, 28 convey the fixed sheet to the rinsing station 13 where a roller pair 29, 30 squeezes off the fixing liquid, and advances the sheet through the water of the rinsing tray 31. Guide plate 32 controls the path of the sheet through the tray and convey the sheet to the outlet roller pair 34, 35 which squeezes of the rinsing liquid which runs back into the tray 31.

The drying station comprises two symmetrically arranged blowers 36, 37, the air of which is passed over heaters 38, 39 before it strikes the sheet. The dried sheet is finally removed from the apparatus by rollers 40, 41.

The transport rollers of the apparatus are driven through worm-and-gear arrangements by a common driving shaft 42 (illustrated in broken lines), which is driven by a motor 43 with inbuilt reduction gear, via a belt 44.

The lick-rollers of the processing trays 19 and 26 are driven in a similar way through worm-and-gear arrangements by a driving shaft 45 (illustrated in broken lines), which is driven by a second motor 46 with inbuilt reduction gear, via a belt 47.

Liquid that is squeezed from a sheet by the roller pair 22, 23 and 29, 30 is absorbed by pads 48 and 49 of a resilient absorbant material.

Figure 5:
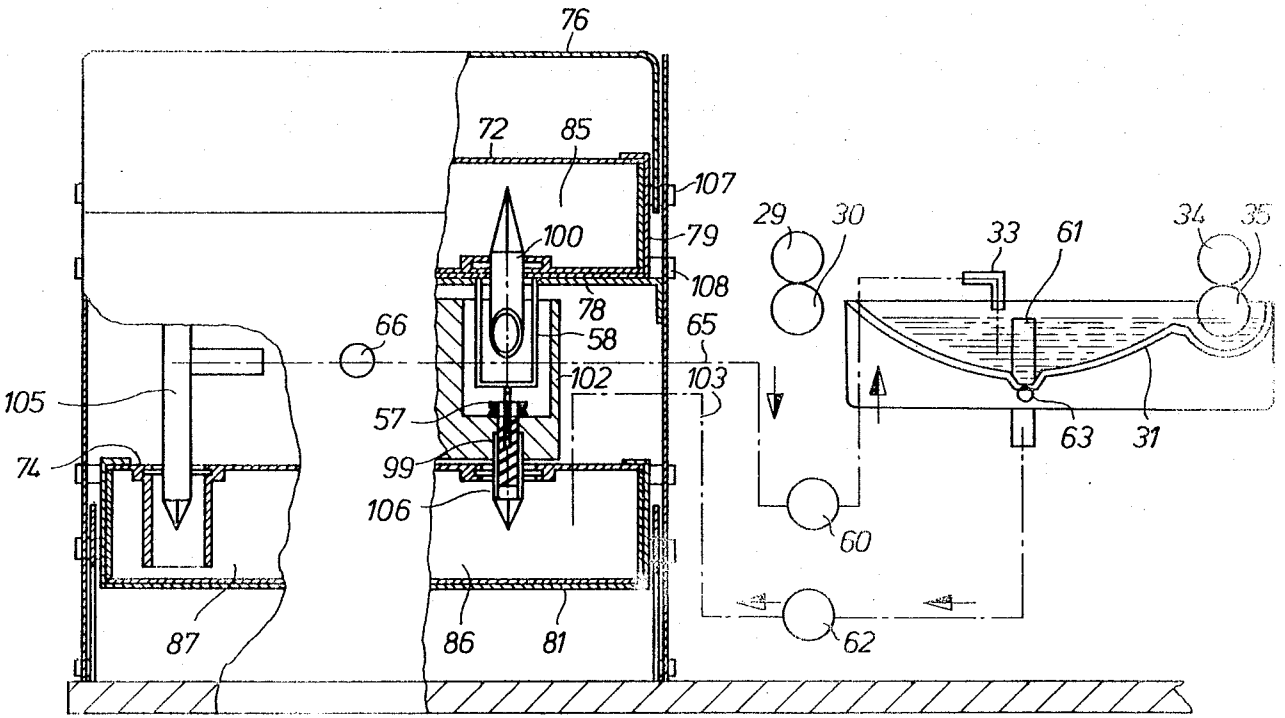
FIG. 5 illustrates a diagrammatic sectional view of the apparatus on line 5—5 of FIG. 2.

The trays 19 and 26 are provided with tubes 50 and 51 via which they are in connection with chicken-feed liquid level control devices, such as the device 52 illustrated in FIG. 3 and the device 102 illustrated in FIG. 5.

A level control device comprises, see for instance the device 52, a filling tube 53 via which liquid can flow from a compartment of the inverted cassette into the device 52. The lower end of the tube has an angled portion that terminates in an opening 54. The top of the opening 54 determines the level 55 of the liquid in the corresponding tray 26. The device 52 further has a discharge opening 56 that is provided with a valve 57 that is controlled by rods 58. The valve is normally kept open by a compression spring 99, but downward displacement of the rods 58 causes the valve to close as will later be described.

The rinsing tray 31 is provided with a filling-tube 33 through which liquid is pumped into the tray by a pump 60 (see FIG. 5), and with an overflow pipe 61 that determines the level of the liquid in the tray, and from with the liquid is withdrawn and returned to the compartment for the rinsing liquid by a pomp 62. The pipe 61 is provided near the bottom of the tray with a small opening 63 that enables the complete emptying of the tray after the arrestment of the apparatus.

The pumps 60 and 62 are in the present example membrane pumps that are driven by a common motor 64. The pumps are adjusted in such a way that the flow rate of the pump 62 is slightly greater than that of the pump 60. Finally, there is provided in the circuit 65 towards the pump 60 a deaeration valve 66 controlled by a solenoid 67, that aerates the suction conduit as the rinsing tank must be emptied.

The cassettes with the processing liquids for the operation of the apparatus are located in a cassette housing 70 that is situated near the entry end of the apparatus, as shown in FIGS. 2 and 3. The housing has an upper section 71 into which a cassette may be placed in an inverted position (this cassette is called hereinafter the "first" cassette 72), a lower section 73 into which a cassette may be placed in an upright position (this cassette is called hereinafter the "second" cassette 74), and a central section 75 in which the two level control devices 52 and 102 are mounted. The upper section 71 may be closed by a hingeable lid 76, whereas the lower section 73 may be closed by a hingeable lid 77. The front side of the lid 76 overlaps the lid 77 so that the lower section is only accessible after the upper one has been opened already.

Figure 6:
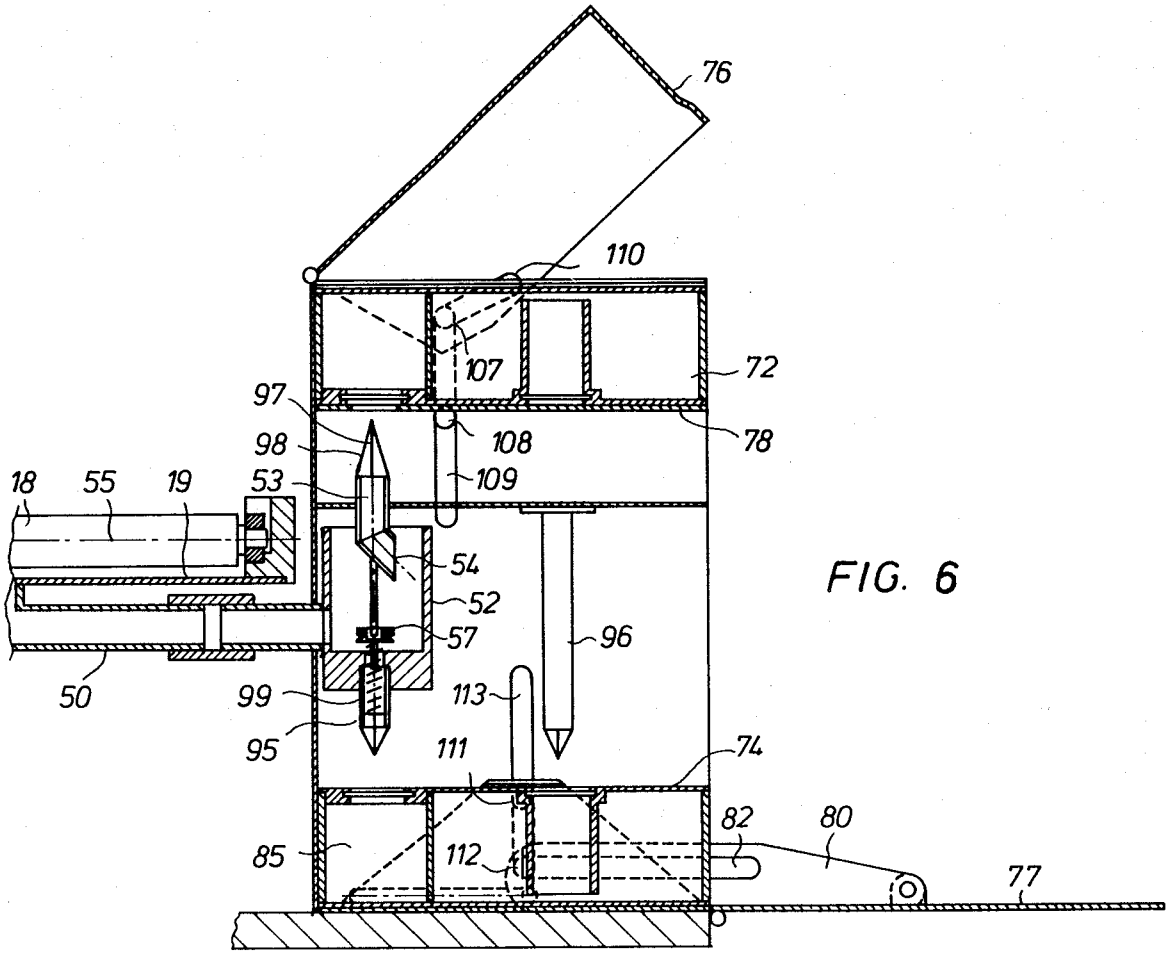
FIG. 6 is a sectional view of the cassettes housing in the completely opened position.
Figure 7:
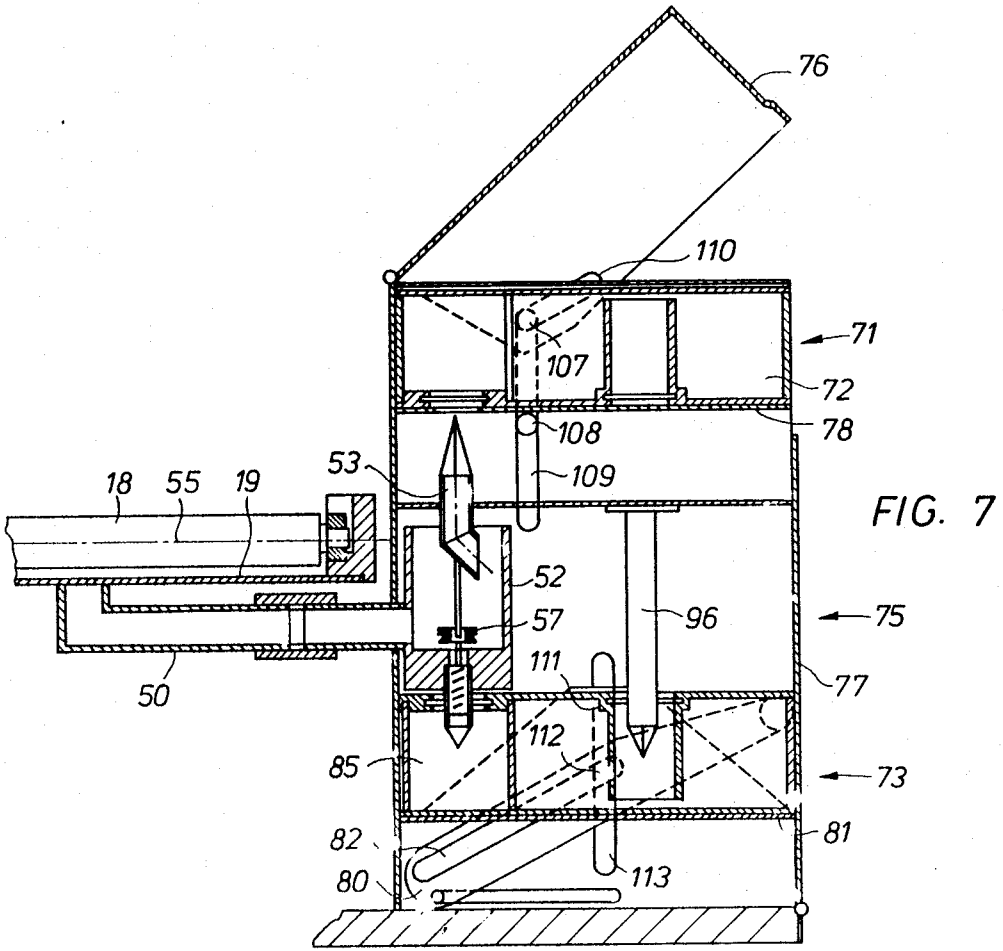
FIG. 7 is a sectional view of the cassette housing in a partly opened position.

The position of the lid 76 controls the vertical position of a platform 78. The platform 78 comprises a horizontal section and two vertical sections, such as the section 79 illustrated in FIG. 5, whereby a kind of open tray is formed into which a cassette may be slid. The horizontal section has openings that correspond with the openings of the cassette compartments as will be described hereinafter. The vertical sections of the platform have vertically spaced guiding pins 107, 108 that slide in a vertical slot 109 in the corresponding lateral wall of the housing 70, and thereby they provide a guide for the platform in the vertical direction. Both lateral walls of the lid are provided with slots, such as the slot 110 illustrated in several figures, that co-operate with the upper guiding pin 107, so that in the open position of the lid, the lid pulls the platform into its "high" position as illustrated in FIGS. 6 and 7, and in the closed position of the lid the platform takes its "low" position as illustrated in FIGS. 3 and 5.

In a similar way the position of the lower lid 77 controls the vertical position of a platform 81 the upstanding walls of which are guided by pairs of guide pins 111, 112 co-operating with a slot 113 in the housing. A slot 82 in an arm 80 linked to the lid 77, co-operates with the lower pin 112 of the platform so that the platform takes its "low" position in the open position of the lid as illustrated in FIG. 6, whereas in the closed position of the lid the platform is lifted into its "high" position as illustrated in FIGS. 3, 5 and 7.

Figure 4B:
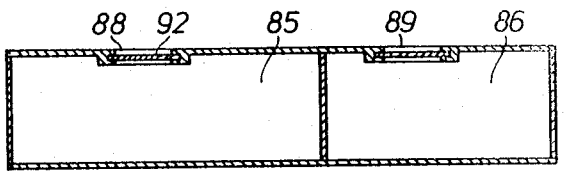
Figure 4C:
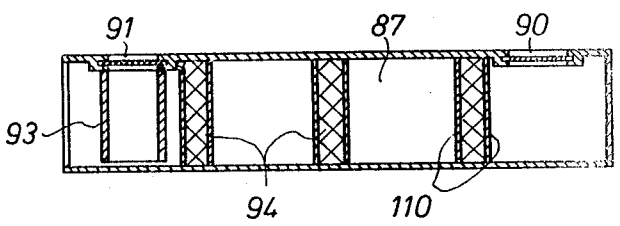
Figure 4A:
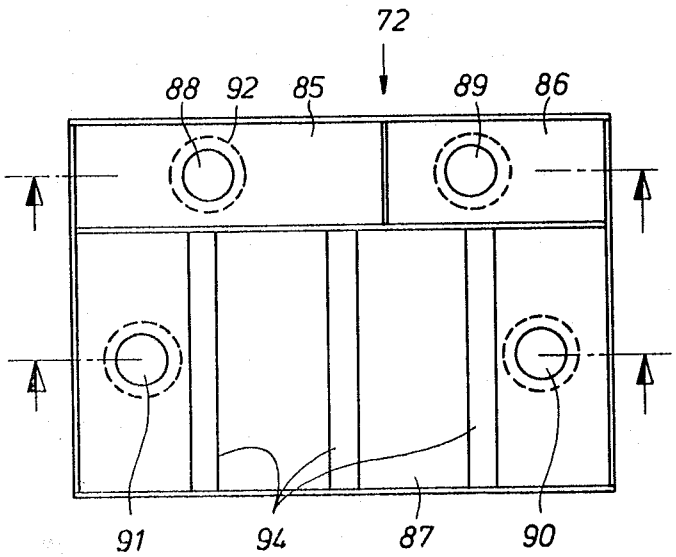

A cassette as used in the present apparatus is illustrated in Figs. 4*a* to 4*c* for the cassette 72, the cassette 74 being identic to the cassette 72. The cassette is a rigid rectangular container preferably made from plastics, such as by injection moulding, and has inner walls that determine three distinct liquid compartments 85, 86 and 87. The compartments are provided with circular openings 88 to 91 that each are sealed by a tight, flexible membrane, such as the membrane 92 sealing the opening 88. The compartment 85 contains the fixing liquid, the compartment 86 contains the activating liquid, and the compartment 87 contains rinsing liquid, e.g. water.

The compartment 87 has two openings, the opening 91 having an inwardly projecting tube 93 that terminates close to the bottom of the cassette. The compartment 87 is also provided with three partitions 94 which are in fact pairs of closely spaced perforated surfaces 147 between which a particulate ion exchange substance, e.g. an anion exchange resin for capturing anionic silverthiosulphate ions is arranged. The partitions 94 may be in the form of a plate of rigid plastic with a thickness of several millimeters, which has a central opening with a relatively large size that is covered on both sides of the plate with a piece of fine meshy fabric, e.g. nylon fabric. In this way, there is formed a chamber that can contain the ion exchanger in the form of granules, or pellets. The partition 94 may also be in the form of a windowlike frame with two closely spaced peripheral borders, onto each of which a sheet of fine fabric is attached.

Ion exchange resins for capturing thiosulphate complexed silver, e.g. from photographic wash waters are commercially available. There use in an ion-exchange column is described e.g. in Journal of Imaging Technology, Vol. 10, No. 6, December 1984, p. 244–246. The rejuvenation of spent photographic fix liquids by phenylthiourea resins as silver ion scavenging agent is described in Photographic Science and Engineering, Vol. 17, No. 3, May/June 1973, p. 282–284. Other suitable resins precipitating silver ions are described in SMPTE Journal, September 1984, p. 800–807.

The operation of the apparatus is now described with reference to the relevant figures, and to FIG. 8 in particular which illustrates the liquid circuit of the apparatus.

Referring to FIG. 6, a fresh cassette with unperforated membranes is placed in an inverted position as the "first" cassette 72 on the platform 78. Then a "start-type" cassette which may be bodily identical to the first one, but which is filled with rinsing water only, is placed on the lower platform 81 in an upright position, to operate as the "second" cassette 74.

The lower lid 77 is closed, see FIG. 7, whereby the cassette 74 is lifted and the four membranes of the cassette become perforated by cross-like cutting knives that are provided at the openings of four tubes 95, 96, 105 and 106 that extend downwardly into the lower section of the housing.

In FIGS. 3, 6 and 7 there are illustrated two tubes 95 and 96, the tube 95 ending in the fixing compartment 85 of the cassette 74, and the tube 96 co-operating with the rinsing compartment.

In FIG. 5 there are illustrated the two tubes 105 and 106, the tube 105 co-operating with the rinsing compartment 85 and the tube 106 ending in the activator compartment 86 of the cassette.

The cross-like cutting knives are in fact two pointed cutting blades, see for instance the blades 97 and 98 in FIG. 6, that are arranged normal to each other to form a cutting tool with four cutting edges, and that merge into a circular liquid conduit, in the present example the tube 99.

Penetration of a membrane by a cutting knife produces two cross-like slits in the membrane that form four flaplike sections of the membrane that are progressively removed from each as the tube enters the membrane. The mentioned sections of the membrane closely fit around the tube owing to the elasticity of the membrane, and thereby a virtually liquid-tight connection has been established (removal of the tube from the membrane causes the deflected membrane sections to return to their initial position, whereby the opening becomes almost completely re-closed).

Then the operator closes the upper lid 76, see FIG. 3, whereby the cassette 72 is displaced downwardly and the membranes of the activating and fixing compartments become penetrated by the corresponding knives of two liquid discharge tubes, namely a tube 53 for the activator compartment 86, see FIG. 3, and a tube 100 for the fixing compartment 85 of the cassette, see FIG. 5.

The downward displacement of the cassette 72 also causes the valves of the two level control devices 52 and 102 to close, this closing being illustrated for the device 102 in FIG. 5. The bottom wall of the cassette 72 urges two parallel pins 58 downwardly whereby the valve 57 becomes pressed on its seat against the action of the compression spring 99.

The seat of the valve may be formed by a bore in the flat bottom wall of the device 102, and the valve itself may be formed by a conventional rubber sealing ring for shaft bearings, consisting of a cylindrical, stiff one half and a flexible, winglike other half. The sealing ring is fitted to a rod that is connected with the pins 58, and the flexible end of the ring faces downwardly so that it can form a liquid tight seal when pressed onto the bottom of the device.

The same occurs for the device 52 so that the processing liquids of the two compartments of the cassette flow through the device 52 and 102 into the corresponding trays 19 and 26, and reach there a level at which the openings of the tubes, such as the opening 54 of the tube 53 in FIG. 3, become closed by the liquid so that no further air is admitted into the corresponding cassette compartment and the liquid discharge is consequently arrested.

Figure 8:
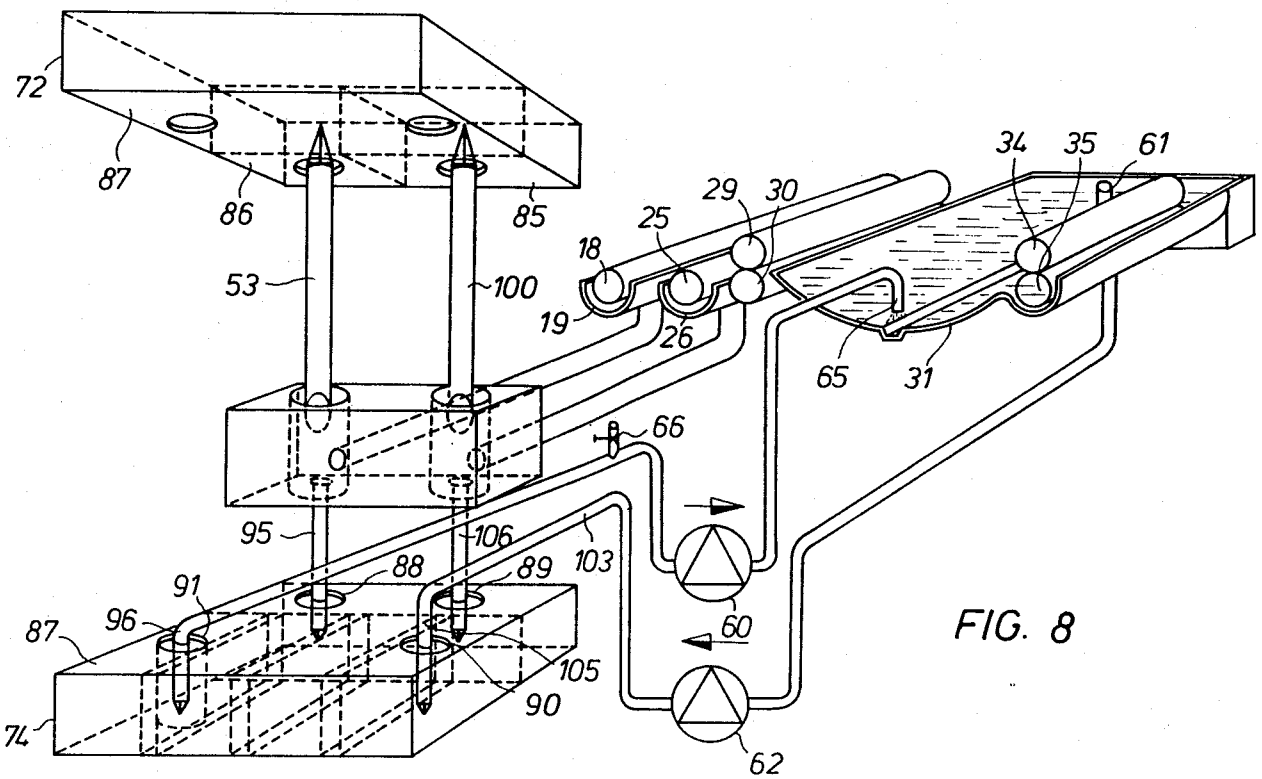
FIG. 8 is a diagrammatic view of the liquid circuits of the apparatus.

Then the driving motors of the rollers, the blowers and also the pumps are started whereby rinsing water is drawn by the pump 60 through conduit 96 from the compartment 87 of the lower cassette 74, and fed to the rinsing tray 31 via the pipe 65, see also FIG. 8. The rate at which liquid is fed into the tray is larger than the rate at which liquid flows out through the bore 63 (see FIG. 5) in the overflow pipe 61, so that after some tens of seconds the liquid reaches the top of the pipe 61 whereby the level of the liquid in the tray is exactly determined. Liquid that discharges in the pipe 61 through the bore 63 and also via the top rim, is sucked off by the pump 62 and returned to the rinsing water compartment of the cassette, through the conduit 103, see FIGS. 5 and 8.

The rate of flow of pump 62 is larger than the rate of pump 60, so that there is no risk for liquid to reach a level in the tray 31 higher than that determined by the overflow tube 61.

The liquid enters the corresponding compartment of the cassette 74 through the opening 90, and flows then towards the left-hand side of the cassette, according to the illustration of FIG. 8, whereby the liquid flows in succession through the ion exchanging three partitions 94 of the compartment. The distribution of the ion-exchanger over three separate places of the compartment has the advantage of a reduced flow resistance of liquid through the compartment, as may be noticed by level differences of the liquid in the four sections of the compartment that do not exceed a few millimeters only in operation of the apparatus.

The purpose of the tube section 93 that extends downwardly from the opening 91, is to ensure that always liquid is sucked into the conduit 96, also in the case when the level of the liquid below the opening 91 becomes low as a consequence of consumption of the liquid by the processed sheets and an increased resistance to liquid (from the right to the left in FIG. 4 a illustration) flow of the ion exchanging partitions 94.

The apparatus is now ready for use and after darkroom conditions have been established one or several microfiches may be introduced in the apparatus at inlet 9. The inlet 9 occasionally be arranged for light-tight co-operation with an appropriate light-tight magazine for loader containing imagewise exposed film sheets or a film length, so that in such case the feeding of the apparatus with exposed film material may occur in daylight. The processed film sheets are discharged by the roller pair 40, 41.

Processing liquids that are consumed by the sheets fed through the apparatus are automatically added in the trays 19 and 26 by the chicken-feed controls once the level of the liquid in the trays has lowered to such an extent that air is admitted through the openings such as opening 54 of the device 52 in FIG. 3, whereas the correct level in the rinsing tray 31 is controlled by the overflow pipe 61.

Liquid that has been squeezed from the sheet by the pressure roller pairs 22, 23 and 29, 30 is collected in the pads 48 and 49. The volume of liquid collected in the pads is limited, and it has been shown that there are no problems with the collecting of the processing liquid from, for instance 20 to 30 film sheets measuring 14.8 by 10.5 cm.

After a sheet, or a plurality of sheets as the case may be, has been processed, the apparatus may be switched-off and left unattended for periods ranging from hours to several days. As a next sheet is to be processed, the apparatus is put into operation for a few seconds, and it has been shown that such short period is sufficient for the removal of deposites and the like dried on the periphery of the different rollers.

As a predetermined number of sheets has been processed, the processing liquids of the apparatus must be renewed. According to a preferred embodiment of the invention, this moment may be signalled in a most simple way, if the manufacturer of the photographic material supplies the film sheets end a cassette with processing liquids for the processing of said film sheets, together in one packaging carton. In this way the operator knows that use of the last film sheet also means the end of the operational life of the processing cassette, and that the opening of a fresh pack will entail the replacement of the used processing cassette.

The replacement of a cassette proceeds as follows. The pumps 60 and 62 being running, the valve 66 is opened whereby pump 60 is no longer capable of withdrawing water from the cassette 74. In consequence, the complete liquid contents of the tray 31 becomes discharged by pump 62 in the cassette 74. Next, the upper lid 76 of the cassette housing 70 is opened whereby the upper cassette 72 is raised and disengaged from the discharge tubes 99 and 100, and whereby also the pinis 58 of the level controls 52 and 102 are no longer depressed, so that the springs 99 urge the corresponding valves of said level controls 52 and 102 in the open position. Thereby the liquids from the trays 19 and 26 flow through the level controls into the corresponding empty compartments of the lower cassette 74, in the present case the "start-up" cassette.

The elasticity of the membranes of the openings of the cassettes is such that these membranes are almost completely closed after a discharging tube with its corresponding cutting knife is withdrawn from the cassette opening. This is a consequence of the fact that no true opening is cut in the membranes, but instead two cross-like slits are formed that permit entry of a tube through the membrane and that also conduct to a nice closing of the membrane once the tube is withdrawn. The result of all this is that the inverted cassette 72 may be withdrawn from the apparatus without any risk for soiling the apparatus by liquid dripping from the cassette.

It will be noticed that the location of the compartments 85 and 86 of the cassette 74 is reversed as compared with the location of these compartments in the upper cassette 72, and this is a consequence of the rotation of the cassette 72 over 180 angular degrees. The consequence of this reversing is that the liquid contents of the upper, larger compartment, namely the fixing compartment 85, becomes discharged into the lower, smaller compartment, namely the activator compartment 81, and vice versa. Yet there is no risk for the amount of fixing liquid to surpass the capacity of the receiving activator compartment, since the processing of the successive sheets has taken away a certain amount of liquid from the fixing tray 26.

Then the lower lid 77 of the apparatus is opened and the lower cassette 74 taken out and discarded. The already removed upper cassette is inserted in an upright position in the lower section of the cassette housing, thereby to operate as the "second" cassette 74.

The operator may now insert the fresh cassette of a new package into the upper section of the apparatus, thereby to operate as the "first" cassette 72.

After the closing of both lids 76 and 77, the apparatus is ready for the processing of a new set of films. The rinsing water of the "second" cassette 74 (i.e. the former "first" cassette) is circulated by the pumps 60 and 62 throught the rinsing tray 31, whereas the activator and fixing liquids of the fresh "first" cassette 72 are fed to the corresponding trays 19 and 26. It is clear that the "second" cassette 74 now operates completely identic to the former "start" cassette, and this process will go on for each further cassette 72 that is transferred to the lower position after its activator and fixing solutions have served for the processing of a pre-determined number of film-sheet.

According to a particular advantage of the present invention, an anion exchanger is provided in the partitions 94 of the rinsing water compartment 87. Herewith thiosulphate and silver thiosulate complex anions are fixed to the ion exchanger, which on saturation can be discarded, rejuvenated or incenerated to recover the silver.

An additional advantage of the use of the cassettes in the described way is that the remaining activator and fixing solutions of the "first" cassette 72 are discharged in the non-corresponding fixing and activator compartments of the "second" cassette 74, whereby these liquids become neutralized to a given extent.

In the operation of the apparatus described hereinbefore, it has been found that favourable results with respect to uniformity and consistency of processing were obtained, if the activator and fixing solutions were thickened by the addition thereto of suitable compounds. Suitable thickening agents are e.g. carboxymethylcellulose, polyacrylamide and glycerol.

The following data illustrate the apparatus described hereinbefore,

Processing speed: 50 $cm.s^{-1}$
Processing width: 10.5 cm
Contents of one packaging carton:
one processing cassette,
25 film sheets measuring 148 mm×105 mm.
Processing cassette:
a plastic holder with 3 perforable compartments for activator liquid, fixing and rinsing liquid respectively The activator compartment contains: 40 cm3 of liquid, which liquid contains the following ingredients:
sodium hydroxide: 60 g/l
sodium sulfite (anh.): 50 g/l
potassium bromide: 2 g/l The fixing compartment contains: 40 cm3 of liquid, which liquid contains the following ingredients:
sodium sulfite (anh.): 29 g/l
sodium acetate (3 aq.): 25 g/l
glacial acetic acid: 23 g/l
citric acid: 4 g/l
ammonium thiosulfate: 220 g/l The rinsing compartment contains 150 cm3 of tap water and LEWATIT M600 (registered trade name of Bayer A.G. Leverkusen, W-Germany) for a co(styrene-divinylbenzene- vinylbenzyl-β-hydroxy-ethyl-dimethylammonium chloride) anion exchange resin. Said resin has an average grain size of 0.5 mm and is provided in each of the three perforate partitions 94 of the rinsing compartment. The quantity of ion-exchange resin used amounts to 20 g per partition.

The use of a particular "start-type" cassette is not imperative, and thus the apparatus may be started for the first time also by means of a normal cassette that contains all the processing liquids. However, in such case the activator and fixing solutions of the cassette will remain unused, since this cassette, which occupies the lower position in the apparatus is used only for its rinsing liquid.

The apparatus may also be operated with classic developer and fixing solutions, but is is clear that in such case the problem of oxidation to the air will require more complicate liquid regeneration means.

The sponge means for the collection of the liquids squeezed from the sheets, may be mounted in cartridges or the like, that may be arranged for easy insertion, and removal from the apparatus. In a favourable way, suchlike cartridges may be provided together with the films and the processing cassette in one packaging carton.

The apparatus may be used as well for the processing of film strips rather than sheets, whereas also photographic material on a paper base may be processed.

Figure 9:
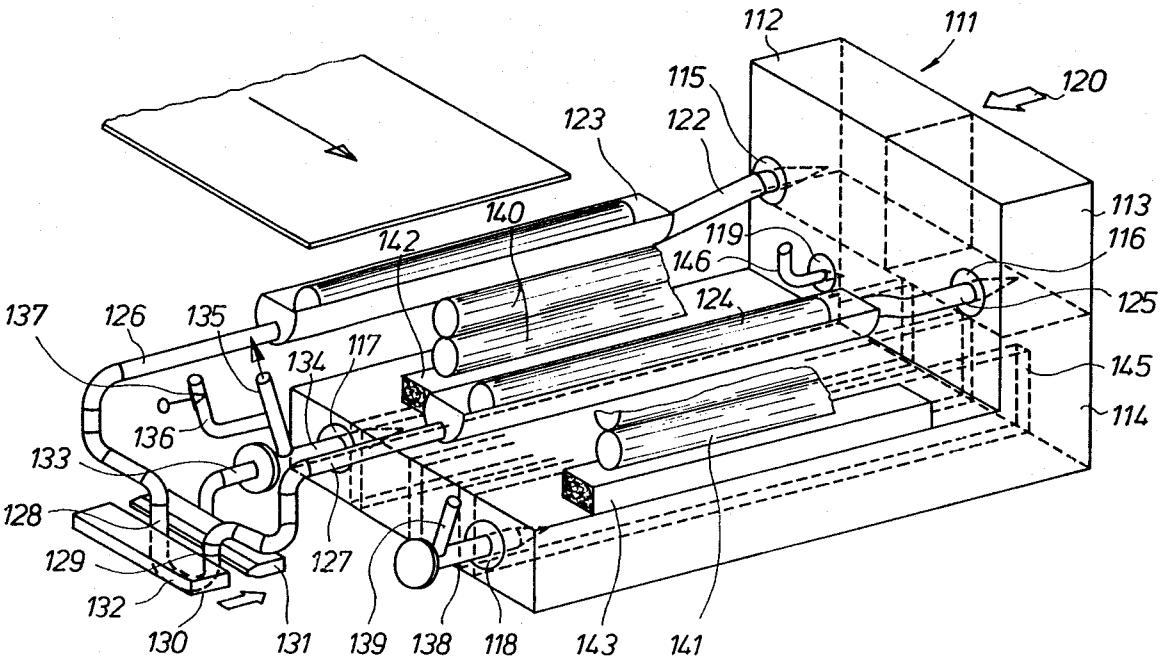
FIG. 9 is a diagrammatic view of an embodiment of an apparatus that operates with one processing cassette.

A second embodiment of the apparatus according to the invention is illustrated in FIG. 9. In this embodiment, one cassette only is ued which contains all the required processing liquids. A cassette 111 which has an L-like shape, has a compartment 112 for the activator liquid, a compartment 113 for the fixing liquid, and a compartment 114 for the rinsing liquid. The compartments 112 and 113 have openings 115 and 116, respectively, that are sealed by perforable membranes, whereas the rinsing compartment has openings 117, 118 and 119 that are likewise sealed by perforable membranes.

The cassette is inserted into the apparatus according to a horizontal movement, indicated by the arrow 120, and as the cassette reaches its ultimate position, the membranes of the different openings are perforated by cross-like knives mounted at the extremity of liquid discharge or reflux tube sections that are similar to the tubes of the apparatus described hereinbefore. The different stations of the apparatus are connected as follows with their corresponding liquid supplies.

The activator station 123 is connected via a pipe 122 with the tube that fits into the opening of the activator compartment. It has been shown that an angle of said pipe with respect to the horizontal which is comprised between approximately 6 and 10 degrees, ensures the air supply in compartment 112 by allowing a smooth entry of air into the compartment as liquid is being consumed.

The fixing station 124 is connected in a similar way via a pipe 125 with the tube section that fits into the opening of the fixing compartment of the cassette. Both stations are provided with liquid discharge conduits 126 and 127 that comprise flexible vertical sections 128 and 129 that may be pinched off by means of a stationary clamping bar 130 and co-operating displaceable bar 131. Both conduits are connected through a T-connection 132 with a conduit 133 towards the tube 134 that fits in the opening 117 of the rinsing compartment of the cassette.

The tube 134 is located at the suction side of the rinsing compartment and is connected via a pipe 135 and a flexible conduit, not illustrated, with the suction side of a first circulation pump. The pipe 135 had a deaeration provision 136 which may be opened by a valve 137. A tube 138 is located at the inlet side of the rinsing compartment and is through a pipe 139 and a flexible conduit, not illustrated, in connection with the outlet of a second circulation pump. The pumps and also the rinsing tray of the apparatus have not been illustrated, but the are identical to the arrangement illustrated in FIG. 8.

The apparatus finally comprises squeegee roller pairs 140 and 141 that squeeze away activator and fixing liquid adhering to a sheet being processed. The removed liquid is collected in absorbent cartridges 142 and 143.

In operation of the apparatus, the liquid level in the stations 123 and 124 lowers as liquid is being taken away by film sheets passed through the stations. It has been shown that a liquid level difference of 5 mm exits between the first and the last processed sheet, but this did not cause any photographic adverse effect. The liquid level in the rinsing station is held constant through an overflow. The overflowing rinsing liquid flows through the tube 118 back in the rinsing compartment of the cassette, and passes in succession through the several partitions 145, illustrated in broken lines, with ion exchange resins. If for one reason or another, a partition 145 would have become blocked or become unsufficiently pervious for the rinsing liquid, then the liquid may flow over the top of such partition at the place of the elevated leg of the compartment. The unhindered circulation of rinsing liquid through the rinsing compartment is made possible by the deaeration tube 146 that fits in the opening 119 of the cassette, and that establishes at any moment atmospheric pressure in the rinsing liquid compartment.

In case the operation of the apparatus is arrested, the level of the activator and of the fixing liquids remain unaltered in the respective trays.

When the processing liquids of the apparatus have become exhausted and the cassette must be replaced, the operator of the apparatus opens the clamp 131, switches on the pumps means, and opens the valve 137. In this way, the liquid from the trays 123, 124 and also from the cassette compartments in connection therewith, flows through the conduits 126, 127 and 133 into the rinsing compartment. Since the valve 137 is opened, the pump withdraws no further liquid from the rinsing compartment. The mentioned operations may also be performed under the control of a microprocessor.

After all the liquid contained in the different trays has been collected in the cassette, the cassette is removed from the apparatus and discarded. The membranes of the different openings being made of a relatively thick elastomer, such as a silicone foil with a thickness of at least 1.0 mm, and the perforation of the membranes being performed by razor-like cutting knives, it has been shown that the membranes close pretty well as the tubes and the cutting knives at their tip are withdrawn therefrom so that there is hardly any leakage of liquid. Also the absorbing cartridges 142 and 142 are replaced by fresh ones, and a fresh cassette 111 is inserted in the apparatus which now is ready for the processing of a next series of photographic sheets.

Finally, the bars 130, 131 are again urged to each other thereby closing the flexible sections 128 and 129, and the valve 137 is closed. Also these operations may be performed under microprocessor control.

We claim:

1. In an apparatus for processing photographic material by contacting the same with at least one active processing liquid and a rinsing liquid, comprising trays for containing a predetermined amount of the respective liquids arranged in succession along a path and adapted to bring said liquids successively into contact with said material along said path, material feeding means for advancing said material along said path, and liquid supply means for supplying said liquids to the respective trays, the improvement wherein said liquid supply means comprises at least one replaceable disposable cassette for providing a supply of the respective liquids and having a plurality of compartments corresponding to the number of liquids to be contracted, at least one compartment of each such cassette containing a supply of one of said liquids with the total supplies of liquids thus contained equal to the number of liquids, each of said cassette compartments including at least one puncturable exterior wall section, a housing for removably supporting each said cassette, separate liquid conduit means extending from one termination at the corresponding housing to an opposite termination at the corresponding tray, each said conduit means including wall puncturing means at the housing termination for puncturing a wall section of the corresponding compartment and projecting into the compartment to establish communication with the liquid supply therein when a cassette is disposed on said housing and flow control means to control the flow of liquid from said supply via said conduit means to the corresponding tray to maintain the predetermined amount of liquid therein.

2. The apparatus of claim 1 wherein said rinsing liquid after use becomes contaminated with contaminant extracted from the material passing therethrough, said flow control means for said rinsing liquid includes means for recirculating used rinsing liquid from said tank to the cassette compartment therefor, and said rinsing liquid compartment is provided with liquid permeable means for scavenging said contaminant from said rinsing liquid.

3. The apparatus of claim 2 wherein the termination of said conduit means at said housing protrudes into the interior of the rinsing liquid compartment adjacent one end thereof, the recirculating means returns used rinsing liquid to the rinsing liquid compartment adjacent an opposite end thereof, and said scavenging means is in the form of at least one water-permeable partition intermediate said compartment ends and through which the used rinse liquid passes before being withdrawn by said conduit means termination.

4. The apparatus of claim 1 including at least one compartment adapted to receive the remainder of each such active processing liquid when the same loses its activity after prolonged use.

5. The apparatus of claim 4 including a plurality of said housings each having a separate cassette, at least one such cassette having a compartment for each such active processing liquid and another such cassette having a compartment for said rising liquid, said one cassette being disposed at a height above said try path and said another cassette being disposed at a height below said tray path.

6. The apparatus of claim 5 wherein said another cassette disposed below said tray path includes at least one empty compartment for each said active processing liquid to receive the remainder of each such active liquid after the same has been used.

7. The apparatus of claim 1 wherein said cassette includes a rack for receiving the associated cassette, each said rack being mounted for movement between a loading position at which said cassette is removed from said conduit means termination and an operating position at which said termination protrudes into the interior of a cassette compartment.

8. The apparatus of claim 6 wherein each said housing encloses the associated cassette and includes a door for permitting introduction and removal of the cassette, and an operating linkage connecting said door and said rack whereby movement of said door between its open and closed position moves said rack between its loading and operating positions.

* * * * *